US007874905B2

(12) United States Patent
Yoshizawa

(10) Patent No.: US 7,874,905 B2
(45) Date of Patent: Jan. 25, 2011

(54) DICE GAME METHOD AND DICE GAME MACHINE

(75) Inventor: Kazumasa Yoshizawa, Tokyo (JP)

(73) Assignee: Universal Entertainment Corporation, Tokyo (JP)

( * ) Notice: Subject to any disclaimer, the term of this patent is extended or adjusted under 35 U.S.C. 154(b) by 557 days.

(21) Appl. No.: 11/875,174

(22) Filed: Oct. 19, 2007

(65) Prior Publication Data

US 2008/0096642 A1 Apr. 24, 2008

(30) Foreign Application Priority Data

Oct. 24, 2006 (JP) ..... 2006-288686

(51) Int. Cl.
*A63F 5/00* (2006.01)

(52) U.S. Cl. ..... 463/16; 273/274

(58) Field of Classification Search ..... 463/22, 463/16; 273/274

See application file for complete search history.

(56) References Cited

U.S. PATENT DOCUMENTS

| | | | | |
|---|---|---|---|---|
| 2,560,187 | A * | 7/1951 | Post | 273/146 |
| 4,906,005 | A * | 3/1990 | Manabe | 463/22 |
| 5,308,081 | A * | 5/1994 | Bartle | 273/274 |
| 5,413,351 | A | 5/1995 | Franklin | |
| 5,964,463 | A * | 10/1999 | Moore, Jr. | 273/274 |
| 5,997,000 | A * | 12/1999 | Nakano et al. | 273/274 |
| 6,123,333 | A * | 9/2000 | McGinnis et al. | 273/146 |
| 6,234,482 | B1 * | 5/2001 | Henderson | 273/274 |
| 6,257,580 | B1 * | 7/2001 | Brown | 273/274 |
| 6,364,314 | B1 * | 4/2002 | Canterbury | 273/274 |
| 6,422,563 | B1 * | 7/2002 | Fairchild et al. | 273/274 |
| 7,258,341 | B2 * | 8/2007 | Pirouzkhah et al. | 273/139 |
| 7,533,885 | B2 * | 5/2009 | Nicely et al. | 273/142 R |
| 2002/0010014 | A1 * | 1/2002 | Parra et al. | 463/17 |
| 2002/0090988 | A1 * | 7/2002 | Frost et al. | 463/17 |
| 2004/0116177 | A1 * | 6/2004 | Frost et al. | 463/17 |
| 2006/0040735 | A1 * | 2/2006 | Baerlocher | 463/26 |
| 2006/0068883 | A1 * | 3/2006 | Randall et al. | 463/20 |
| 2006/0073887 | A1 * | 4/2006 | Nguyen et al. | 463/27 |
| 2006/0157928 | A1 * | 7/2006 | O'Halloran | 273/142 R |

(Continued)

OTHER PUBLICATIONS

U.S. Appl. No. 11/872,212, filed Oct. 15, 2007, Yoshizawa.

(Continued)

*Primary Examiner*—Peter DungBa Vo
*Assistant Examiner*—Omkar Deodhar
(74) *Attorney, Agent, or Firm*—Oblon, Spivak, McClelland, Maier & Neustadt, L.L.P.

(57) ABSTRACT

To provide a dice game machine that can be improved in amusement, including: a gaming section 3 in which one or more dice roll and stop; a player terminal 4 having a BET display unit which enables BET operations predicting rolled numbers on the one or more dice rolled and stopped in the gaming section 3, a player gaming section 100 which is installed in the player terminal 4 and in which one or more dice roll and stop, and a control unit which controls rolling and stopping operations of the one or more dice in the gaming section 3 and controls BET operations from the player terminal 4 and payout processing of a gaming value corresponding to an award ratio, wherein this control unit accepts BET operations predicting rolled numbers on the one or more dice rolled in the gaming section 3 and rolled numbers on the one or more dice rolled in the player gaming section 100.

7 Claims, 11 Drawing Sheets

U.S. PATENT DOCUMENTS

2006/0237905 A1* 10/2006 Nicely et al. ..... 273/274
2007/0026930 A1* 2/2007 Frost et al. ..... 463/17
2007/0060262 A1* 3/2007 Kosaka et al. ..... 463/16
2007/0060301 A1* 3/2007 Lin ..... 463/22
2007/0167217 A1* 7/2007 Kaminkow et al. ..... 463/20
2008/0079218 A1* 4/2008 Morris et al. ..... 273/292
2008/0161101 A1* 7/2008 Lutnick et al. ..... 463/25
2009/0186688 A1* 7/2009 Mourad ..... 463/22

OTHER PUBLICATIONS

U.S. Appl. No. 11/872,197, filed Oct. 15, 2007, Yoshizawa.
U.S. Appl. No. 11/875,118, filed Oct. 19, 2007, Yoshizawa.

* cited by examiner

DICE GAME METHOD AND DICE GAME MACHINE

RELATED APPLICATION

This application claims the priority of Japanese Patent Application No. 2006-288686 filed on Oct. 24, 2006, which is incorporated herein by reference.

BACKGROUND OF THE INVENTION

1. Field of the Invention

The present invention relates to a dice game method in which rolled numbers on a plurality of dice when rolled are predicted and a dice game machine for performing such a dice game method.

2. Description of the Prior Art

Generally, various game machines are installed in a game hall or casino, and among these, there is a dice game machine in which a BET operation predicting rolled numbers on a plurality of dice when rolling these is performed. For dice games, various rules and machines for performing these have been proposed, and for example, in U.S. Pat. No. 5,413,351, a game method is disclosed in which after a player performs a BET operation, a dealer rolls dice, and when the results of rolling are in a predetermined combination, a player can roll a dice and acquire a high award. As a dice game that people are conventionally familiar with, a dice game called Sic Bo in which a BET operation is performed by predicting rolled numbers on three dice rolled is known.

Sic Bo is widely known as a dice game from ancient China, and is a dice game in which a BET is made by predicting being rolled numbers on three dice after rolled or a combination of the numbers. The method of making a BET and an award ratio are indicated on a table at which players sit (may be displayed on an image display device), and on the table, an area for making a BET predicting a rolled number on one dice rolled, an area for making a BET predicting that rolled numbers on two dice are the same, an area for making a BET predicting that rolled numbers on three dice are the same, an area for making a BET predicting a combination of rolled numbers on two dice rolled, and an area for making a BET predicting a total of rolled numbers on three dice rolled are provided. The award ratio is set to approximately 1 to 1 through 1 to 180 according to an appearance probability although this cannot be determined constantly according to circumstances of the regions and countries.

A dice game proposed in U.S. Pat. No. 5,413,351 as described above is performed according to special rules, however, there is a problem that people are not familiar with this game and its special rules and therefore this game lacks amusement. The Sic Bo generally widely known is familiar to people, so that it can amuse players, however, the BET patterns are limited, so that there is still room for upgrading in terms of improvement in amusement. In detail, in the BET region whose appearance frequency is low and award ratio is highest (approximately 1 to 180), it is considered that a player performs a BET operation in an excited state, however, in this BET region, it is only predicted that rolled numbers on three dice rolled are the same (the combination of rolled numbers on the dice is (1, 1, 1), (2, 2, 2) . . . (6, 6, 6)), and this area lacks excitement when making a BET.

The present invention was made in view of the above-described problem, and an object thereof is to provide a dice game method and a dice game machine which can further improve amusement.

SUMMARY OF THE INVENTION

In order to achieve the above-described object, (1) In a dice game method, a gaming section in which one or more dice roll and a player terminal in which rolled numbers on the one or more dice rolled in the gaming section can be predicted and bet, are used, a player gaming section in which one or more dice roll is installed in the player terminal, and the dice game method includes a gaming mode including the steps of: predicting and betting rolled numbers on the one or more dice to be determined in the gaming section and rolled numbers on the one or more dice to be determined in the player gaming section; and providing an award according to the BET.

(2) The dice game method according to (1), wherein a special award can be provided under conditions that rolled numbers on the one or more dice rolled in the gaming section and rolled numbers on the one or more dice rolled in the player gaming section are in a predetermined combination and a player who is playing at the player gaming section made a BET predicting the predetermined combination.

(3) The dice game method according to (1), wherein when rolled numbers on the one or more dice rolled in the gaming section and rolled numbers on the one or more dice rolled in the player gaming section are in a predetermined combination, the player is allowed to play a special game.

(4) A dice game machine includes a gaming section in which one or more dice roll and stop; a player terminal including a BET display unit which enables BET operations, a player gaming section in which one or more dice roll and stop, and a player terminal control unit which controls rolling operations of the one or more dice in the player gaming section; a control unit which controls rolling operations of one or more dice in the gaming section and controls awarding based on a BET operation from the player terminal, wherein the control unit accepts: a BET operation predicting rolled numbers on the one or more dice in the gaming section and a BET operation predicting rolled numbers on the one or more dice in the player gaming section from the player terminal.

(5) The dice game machine according to (4), wherein the control unit executes special awarding processing for a player terminal under conditions that rolled numbers on one or more dice rolled in the gaming section and rolled numbers on one or more dice rolled in the player gaming section are in a predetermined combination and a player playing with the player terminal has performed a BET operation predicting the predetermined combination.

(6) The dice game machine according to (4), wherein when rolled numbers on one or more dice rolled in the gaming section and rolled numbers on one or more dice rolled in the player gaming section are in a predetermined combination, the corresponding player terminal is allowed to perform a special game.

(7) The dice game machine according to (4), wherein a plurality of player terminals are installed, and the control unit executes accumulation processing in a predetermined percentage of BET amounts of BET operations accepted from a plurality of player terminals, and when any player terminal wins a predetermined winning, executes payout processing of the accumulated amount until the winning.

According to the present invention, a dice game method and a dice game machine which can be further improved in amusement are obtained.

Additional objects and advantage of the invention will be set forth in the description which follows, and in part will be obvious from the description, or may be learned by practice of the invention. The objects and advantages of the invention may be realized and obtained by unit of the instrumentalities and combinations particularly pointed out hereinafter.

BRIEF DESCRIPTION OF THE SEVERAL VIEWS OF THE INVENTION OF THE DRAWINGS

The accompanying drawings, which are incorporated in and constitute a part of the specification, illustrate embodiments of the invention and together with the general description given above and the detailed description of the embodiments given below, serve to explain the principals of the invention.

DESCRIPTION OF THE PREFERRED EMBODIMENTS

Figure 1:
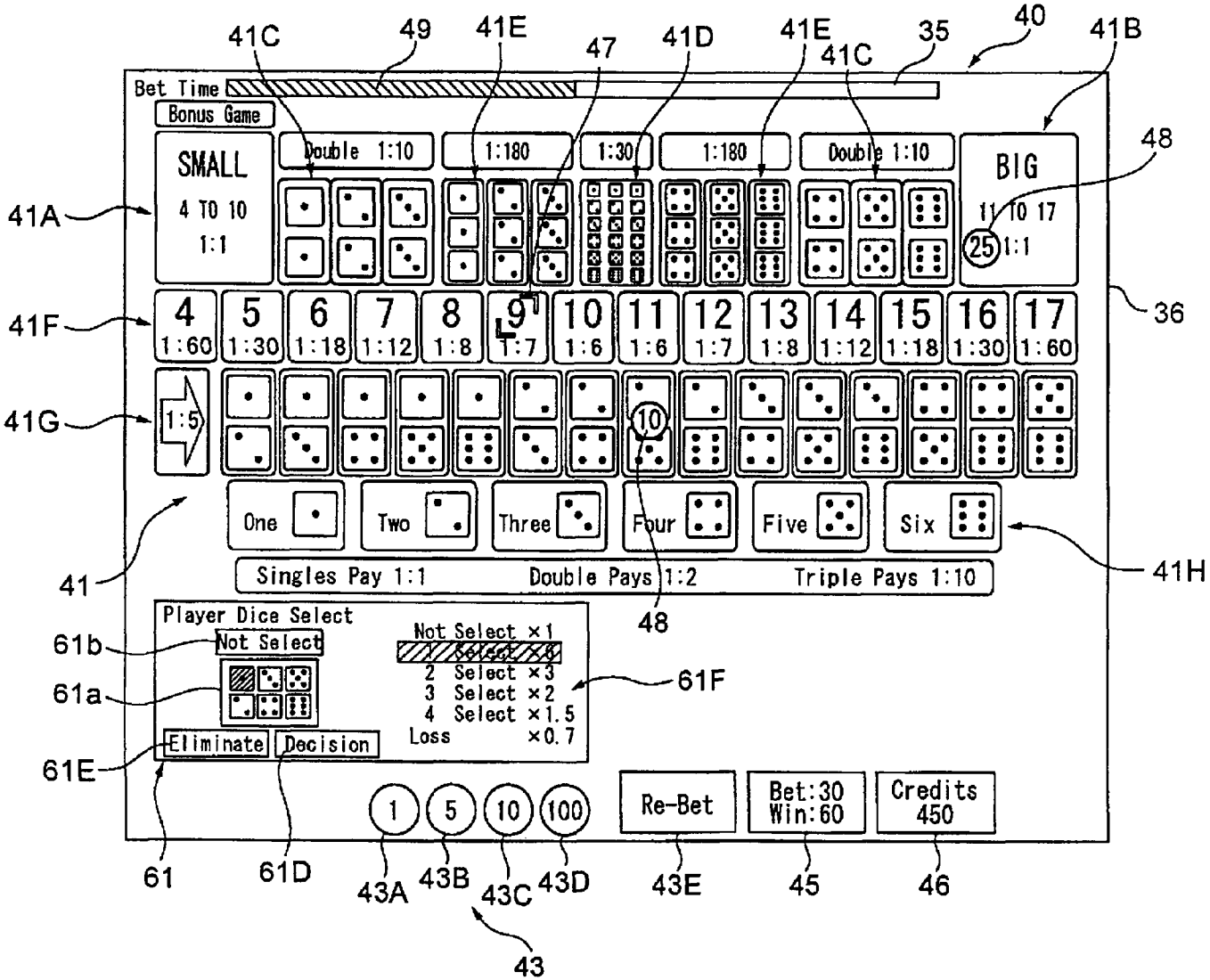
FIG. 1 is a drawing showing a display example on a BET screen for enabling BET operations.

A dice game method of this embodiment is performed between a gaming section and a player terminal by using the gaming section in which one or more dice roll and the player terminal in which rolled numbers on the one or more dice rolled in the gaming section can be predicted and bet, and a player gaming section in which one or more dice roll is installed in the player terminal, and the dice game method includes a gaming mode including the steps of: predicting and betting rolled numbers on the one or more dice to be determined in the gaming section and rolled numbers on the one or more dice to be determined in the player gaming section; and providing an award according to the BET.

In this dice game method, rolled numbers on one or more dice rolled in the player gaming section installed in a player terminal can be predicted in addition to prediction of rolled numbers on one or more dice rolled in the gaming section, and objects to be bet on can be increased. That is, in comparison with a conventional dice game method using a plurality of dice similar to each other, in addition to rolled numbers on one or more dice rolled in a normal gaming section, rolled numbers on one or more dice rolled in a player gaming section installed in each player terminal portion can also be predicted, so that according to this prediction, BET patterns can be increased, so that amusement can be improved.

Under conditions that rolled numbers on one or more dice rolled in the gaming section and rolled numbers on one or more dice rolled in the player gaming section are in a predetermined combination and a player who is playing at the player gaming section made a BET predicting the predetermined combination, a special award can be provided.

In this dice game method, rolled numbers on one or more dice rolled in the gaming section and rolled numbers on one or more dice rolled in the player gaming section are related to each other, so that a mode with a reduced winning probability appears, and accordingly, a higher award ratio can be set, and thereby, amusement can be improved. The special award ratio mentioned herein corresponds to an award ratio higher than a normal award ratio that is obtained when predicted rolled numbers on one or more dice rolled in the gaming section are won.

As another embodiment, when rolled numbers on the one or more dice rolled in the gaming section and rolled numbers on the one or more dice rolled in the player gaming section are in a predetermined combination, the player is allowed to play a special game.

In this dice game method, when rolled numbers on one or more dice rolled in the gaming section and rolled numbers on one or more dice rolled in the player gaming section are in a predetermined combination, there is possibility that a special game such as a bonus game in which a large amount of gaming values can be acquired is performed for a player, so that amusement is improved. The bonus game may not always be performed when rolled numbers on one or more dice rolled in the gaming section and rolled numbers on one or more dice rolled in the player gaming section are in a predetermined combination. For example, it is allowed that the bonus game is performed when a player made a BET predicting the predetermined combination.

In order to perform the above-described dice game methods, a dice game machine is provided which includes: a gaming section in which one or more dice roll and stop; a player terminal including a BET display unit which enables BET operations, a player gaming section in which one or more dice roll and stop, and a player terminal control unit which controls rolling operations of the one or more dice in the player gaming section; and a control unit which controls rolling operations of one or more dice in the gaming section and controls awarding based on a BET operation from the player terminal, wherein the control unit accepts: a BET operation predicting rolled numbers on the one or more dice in the gaming section and a BET operation predicting rolled numbers on the one or more dice in the player gaming section from the player terminal.

According to this dice game machine, for example, in a central area of a casing, a gaming section in which one or more dice roll and stop is installed, and around this, player terminals which allow a plurality of players to participate can be installed, and a player can perform a BET operation from a player terminal by predicting results of rolled numbers on one or more dice rolled in the gaming section. In addition, in a player terminal, a player gaming section exclusive to a player who performs a BET operation there is installed, and the player can predict rolled numbers on one or more dice rolled in the player gaming section installed in the player terminal as well as prediction of rolled numbers on one or more dice rolled in the gaming section, so that objects to be bet on can be increased. That is, in comparison with a conventional dice game machine using a plurality of dice similar to each other, rolled numbers on one or more dice rolled in the player gaming section installed in the player terminal portion can also be predicted in addition to the rolled numbers on one or more dice rolled in the normal gaming section, so that BET patterns can be increased accordingly, and amusement can be improved.

The control unit executes special awarding processing for a player terminal under conditions that rolled numbers on one or more dice rolled in the gaming section and rolled numbers on one or more dice rolled in the player gaming section are in a predetermined combination and a player playing with the player terminal performed a BET operation predicting the predetermined combination.

In this dice game machine, rolled numbers on one or more dice rolled in the gaming section and rolled numbers on one or more dice rolled in the player gaming section are related to each other, so that a mode with a reduced winning probability appears, and accordingly, a higher award ratio can be set, and thereby, amusement can be improved. The special award ratio mentioned herein corresponds to a payout higher than a normal award ratio that is obtained when rolled numbers on one or more dice rolled in the gaming section are predicted and won.

As still another embodiment, when rolled numbers on one or more dice rolled in the gaming section and rolled numbers on one or more dice rolled in the player gaming section are in a predetermined combination, the corresponding player terminal is allowed to perform a special game In this dice game machine, when rolled numbers on one or more dice rolled in the gaming section and rolled numbers on one or more dice rolled in the player gaming section are in a predetermined combination, there is a possibility that a special game in which a large amount of gaming values can be acquired like a bonus game is performed for the player, so that amusement can be improved. The bonus game may not always be performed when rolled numbers on one or more dice rolled in the gaming section and rolled numbers on one or more dice rolled in the player gaming section are in a predetermined combination. For example, it is also allowed that the bonus game is performed when a player made a BET predicting the predetermined combination.

Further, in the above-described dice game machine, a plurality of player terminals are installed, and the control unit executes accumulation processing in a predetermined percentage of BET amounts of BET operations accepted from a plurality of player terminals, and when any player terminal wins a predetermined winning, executes payout processing of the accumulated amount until the winning.

This dice game machine has a so-called progressive function which accumulates the BET amounts from the plurality of player terminals in a predetermined percentage each time a game is performed, and when a predetermined winning is won in any player terminal, the accumulated amount until this winning is paid out, so that the player's curiosity can be increased and many players can be motivated to participate in the game. As conditions for acquiring a predetermined winning in any player terminal, various conditions can be set, for example, when rolled numbers on one or more dice rolled in the gaming section and rolled numbers on one or more dice rolled in the player gaming section are in a predetermined combination (it makes no difference if the player bet on this predetermined combination or not), internal lottery processing was held in the control unit and won, or when the bonus game is performed, a predetermined winning is won.

Thus, the dice game of this embodiment includes a gaming section in which one or more dice roll and a player gaming section (player gaming machine exclusive to an individual player who participates in the game), and a player can perform a BET operation by predicting rolled numbers on dice rolled in the gaming section and the player gaming section. In detail, as described in the embodiment below, in the gaming section, for example, three dice are rolled, and a player can perform a BET operation by predicting rolled numbers on the dice, and in the player gaming section, for example, one dice is rolled and the player can perform a BET operation by predicting a rolled number on the dice.

At this time, by relating the rolled numbers on dice rolled in the gaming section and the rolled numbers on dice rolled in the player gaming section to each other, patterns to be bet on are increased, and the winning probability is reduced, whereby a higher award ratio can be provided. The BET operation is for, for example, a BET area 41 (for predicting rolled numbers on dice rolled in the gaming section) and a BET area 61 (for predicting rolled numbers on dice rolled in the player gaming section) shown in FIG. 1, and the rolled numbers on dice in the gaming section and the player gaming section can be related to each other and predicted.

Hereinafter, a dice game method and a dice game machine according to this embodiment will be described in detail with reference to the accompanying drawings.

Figure 2:
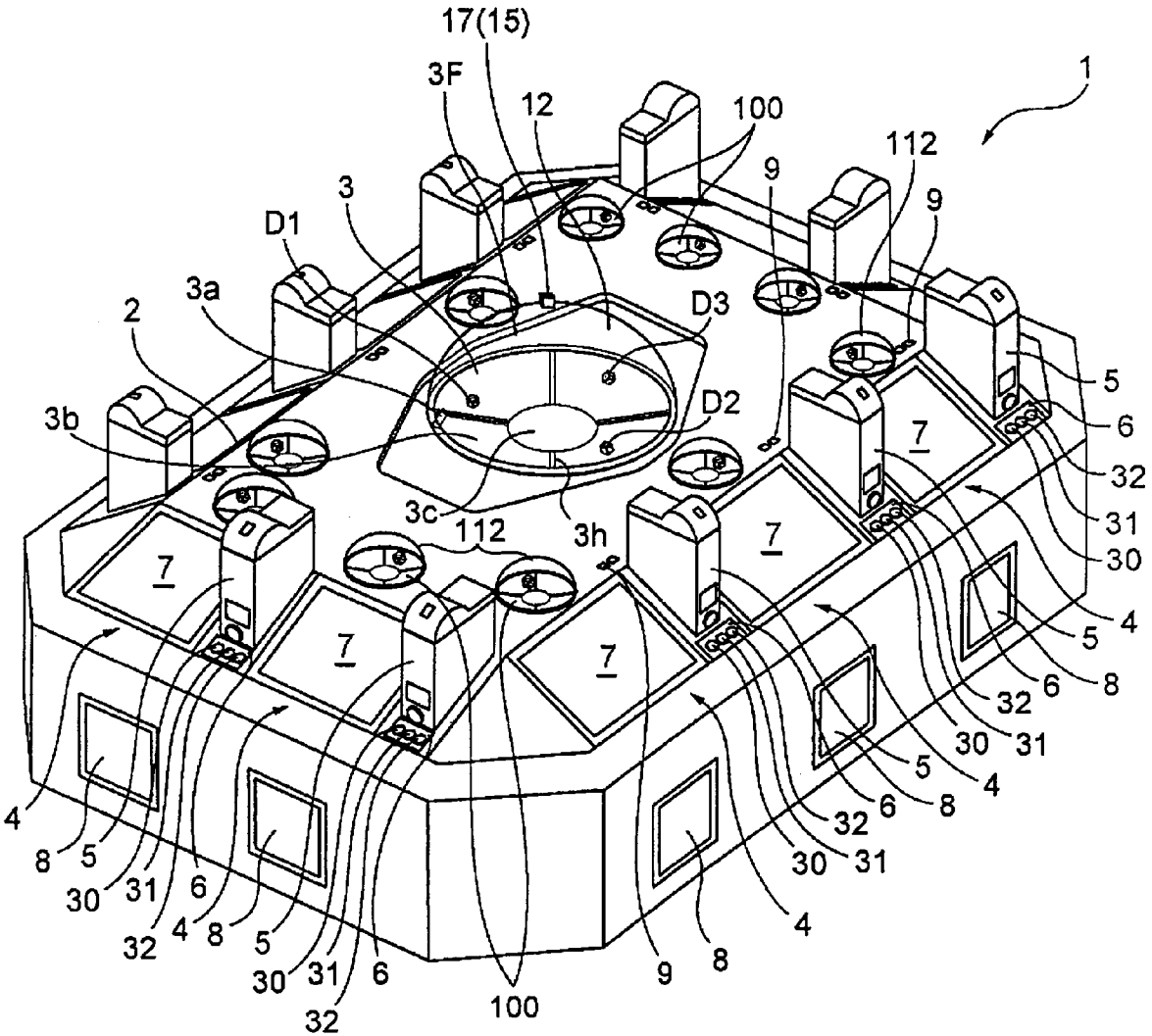
FIG. 2 is a perspective view showing an entire construction showing an example of a dice game machine of the present invention.
Figure 3:
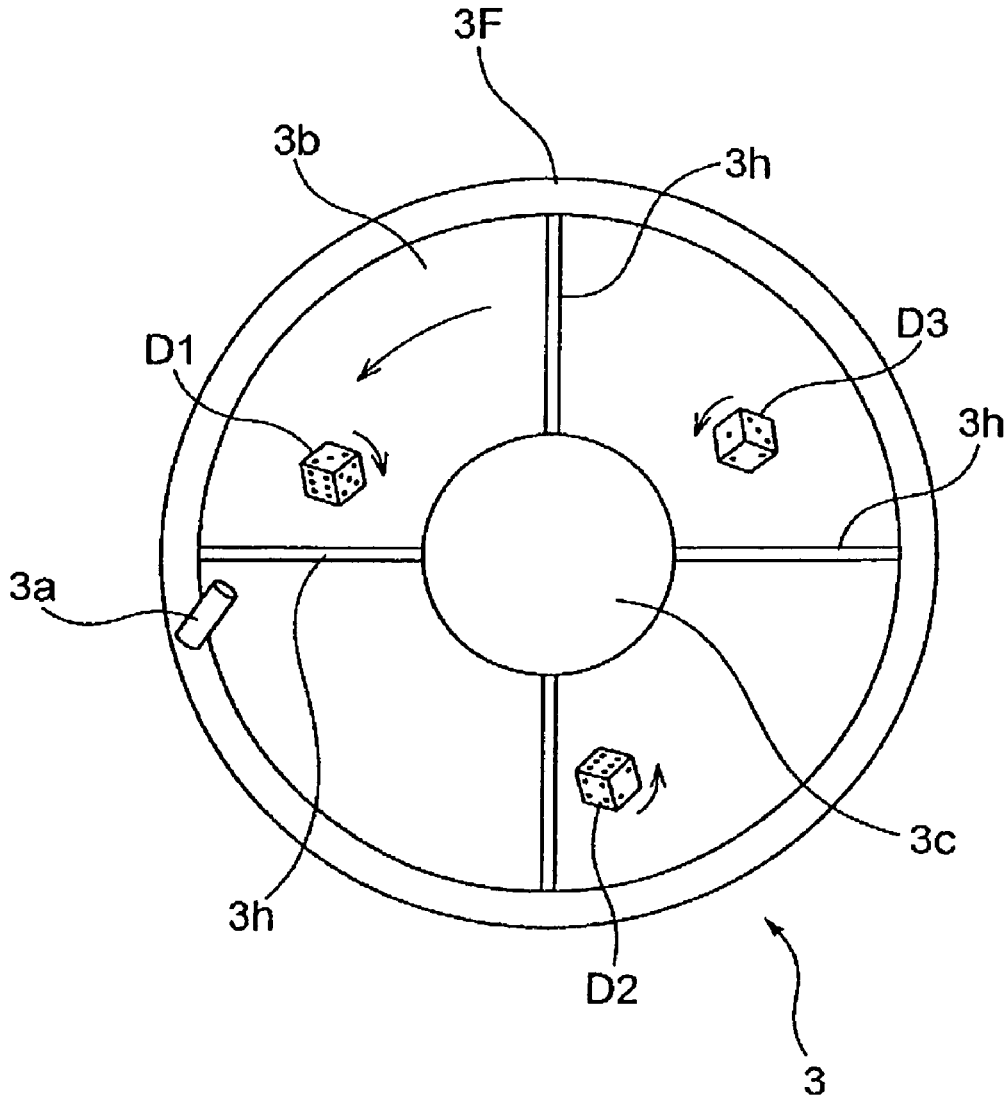
FIG. 3 is a plan view showing a construction of a gaming section.
Figure 4:
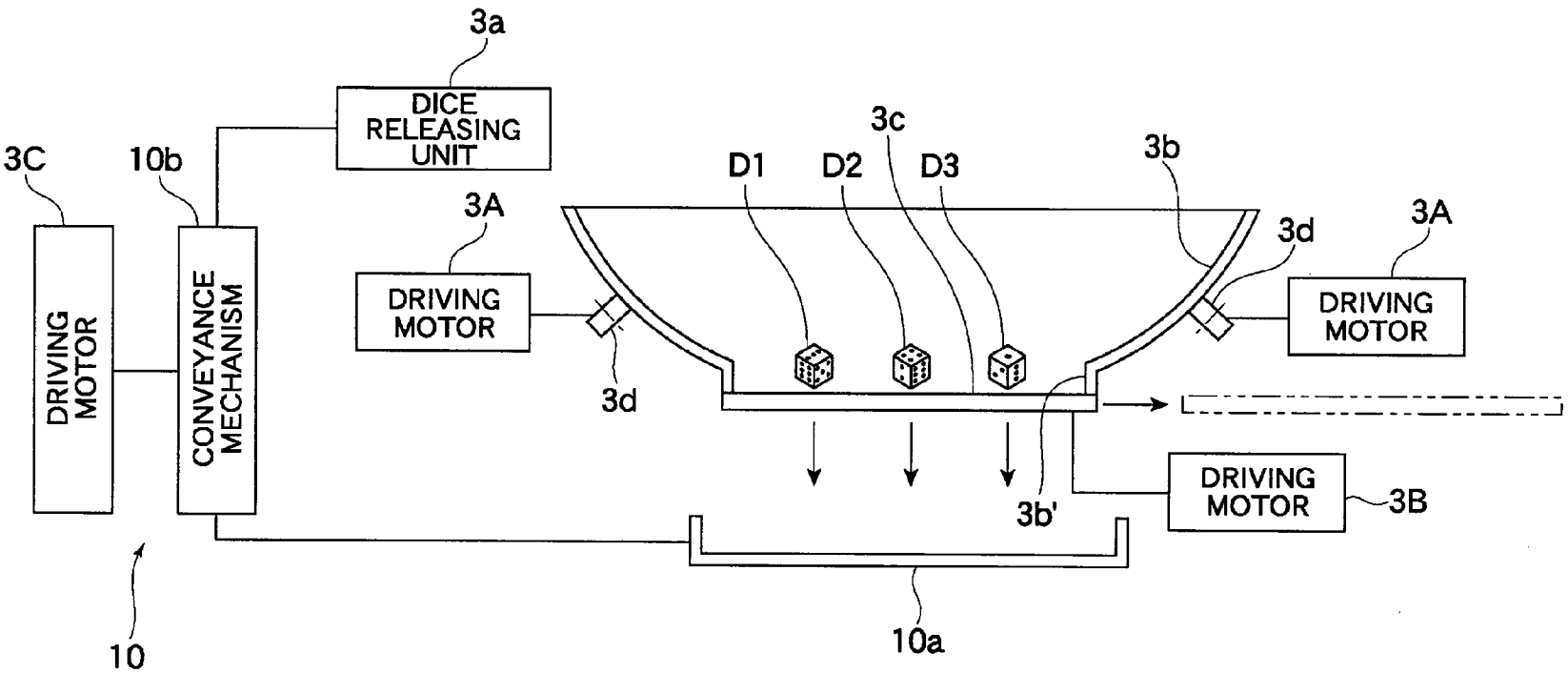
FIG. 4 is a drawing showing a schematic construction of the structure of the gaming section.
Figure 5:
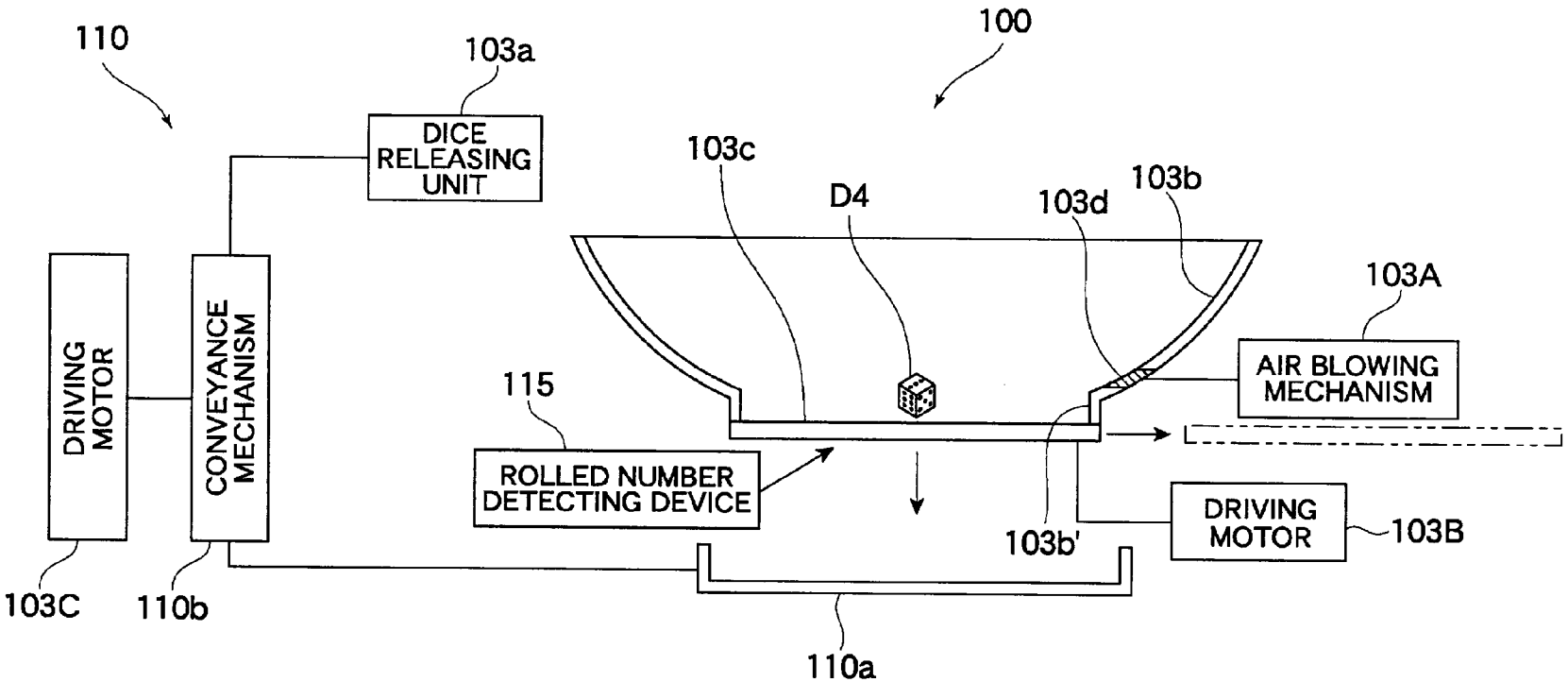
FIG. 5 is a drawing showing a schematic construction of a structure of a player gaming section.

FIG. 2 is a perspective view showing an embodiment of a dice game machine, FIG. 3 is an enlarged view of a gaming section (section in which three dice roll and stop) of the dice game machine shown in FIG. 2, FIG. 4 is a schematic view of a path from collection to release of dice in the gaming section; and FIG. 5 is a schematic view of a path from collection to release of dice in the player gaming section installed in each player terminal.

A dice game machine 1 includes a casing 2 as a main body, a dice game performing section (hereinafter, referred to as gaming section 3) which is provided substantially at a central portion of an upper surface of the casing 2 and in which one or more dice roll and stop, and a plurality (ten in this embodiment) of player terminals 4 installed around the gaming section 3 so as to surround the gaming section 3.

The player terminal 4 is constructed so that a player can perform a BET operation, and includes at least a game media accepting device 5 into which game media such as coins or medals to be used for gaming are inserted, a controller 6 consisting of a plurality of control buttons, etc., into which a predetermined instruction is inputted by a player, and an image display device 7 for displaying mainly an image relating to a BET table when playing a game. By operating the controller 6, etc., while looking at an image displayed on the image display device 7, a player can participate in a game continuously performed in the gaming section 3.

In side surfaces of the casing 2 in which the respective player terminals 4 are installed, payout openings 8 for paying-out game media that players have are formed, respectively. On the upper right of the image display device 7 of each player terminal 4, a speaker 9 for playing music or effect sounds is provided.

In each player terminal 4, a dice game performing section (hereinafter, referred to as a player gaming section 100) exclusive to a player in which one or more dice roll and stop is installed exclusively to a player who plays the game with this terminal. A player seated at the player terminal 4 can perform a BET operation predicting rolled numbers on dice (one or more dice) rolled and stopped in the gaming section 3 and rolled numbers on dice (one or more dice) rolled and stopped in the player gaming section 100.

In the gaming section 3, one or more dice are rolled and stopped. In this embodiment, as in the case of Sic Bo conventionally known, three dice D1, D2, and D3 are used in the gaming section 3.

The gaming section 3 is entirely formed into a substantially circular shape, and includes a dice releasing unit 3*a* from which the dice D1, D2, and D3 described above are released when gaming, a rotary plate 3*b* for rolling the dice D1, D2, and D3 released from the dice releasing unit 3*a*, and a stop plate for finally stopping the dice rolling on the rotary plate 3*b*.

The dice releasing unit 3*a* is set on a circular outer frame 3F of the gaming section 3, and from this dice releasing unit, dice D1 through D3 are successively (or simultaneously) released toward the rotary plate 3*b*.

The rotary plate 3*b* is formed into a so-called cone shape gradually sloping downward to the inner side from the circular outer frame 3F, and is supported rotatably in a state that a plurality of drive rollers 3*d* are in contact with a lower surface of the rotary plate. In response to start of gaming, the plurality of drive rollers 3*d* are driven and rotated by the rotary plate driving motor 3A, whereby the rotary plate 3*b* is driven and rotated. On the surface of the rotary plate 3*b*, projections 3*h* are formed at predetermined intervals (for example, formed so as to extend radially at substantially 90-degree intervals), and when driving and rotating the rotary plate 3*b*, bounce the respective dice so that the dice easily roll.

The stop plate 3*c* is formed into a circular plate on the bottom of the cone-shaped rotary plate 3*b*, and is an area in which the dice D1, D2, and D3 rolling on the rotary plate 3*b* drop according to the stop of the rotary plate 3*b* along the slope of the rotary plate and finally stop. That is, the dice D1, D2, and D3 released from the dice releasing unit 3*a* roll on the surface of the rotary plate according to rotation of the rotary plate 3*b*, and when the rotary plate 3*b* stops, they drop along the slope surface of the rotary plate and finally stop on the stop plate 3*c*.

The stop plate 3*c* is constructed so as to be driven to slide by a stop plate driving motor 3B as shown in FIG. 4, and by driving the stop plate 3*c* to slide, the dice D1, D2, and D3 drop toward a collect/release mechanism 10 while colliding with a contact portion 3*b*' formed on the bottom of the rotary plate 3*b*.

The collect/release mechanism 10 includes an accommodation unit 10*a* which receives dropped dice from the stop plate 3*c*, a conveyance mechanism 10*b* which conveys the dice in the accommodation unit 10*a* toward the dice releasing unit 3*a*, and a conveyance driving motor 3C which drives the conveyance mechanism 10*b*. In this case, this structure is not limited to a special form as long as the collect/release mechanism 10 is constructed so as to collect the dice after rolled numbers on dice stopping on the stop plate 3*c* are detected by a rolled number detecting device 15, and release the dice toward the rotary plate 3*b* from the dice releasing unit 3*a* again. That is, for example, the conveyance mechanism 10*b* can be carried out in various embodiments in which dice are conveyed by air pressure toward the dice releasing unit 3*a* from the accommodation unit 10*a*, or the dice are conveyed toward the dice releasing unit 3*a* from the accommodation unit 10*a* by a conveying body such as a conveyor.

The entire upper side of the gaming section 3 is covered by a transparent acrylic cover member 12, whereby rolling ranges of the respective dice are restricted.

In the player gaming section 100, one or more dice are rolled and stopped. In this embodiment, normally, one dice D4 is used, and as described later, when a bonus game which allows a player to acquire a comparatively large amount of gaming values is won, three dice are used. In this player gaming section 100, concurrently with release and rolling of three dice in the gaming section 3, one dice is released and rolled, and in each player terminal 4, such one dice is released and rolled. Therefore, the rolled numbers on the three dice rolled in the gaming section 3 are common to players, and on the other hand, the rolled number on one dice rolled in the player gaming section 100 is identified for each player terminal.

The player gaming section 100 installed in each player terminal 4 may be formed by only downsizing the gaming section 3, or may be formed of a different structure. In this embodiment, the player gaming section 100 is entirely formed into substantially a circular shape similar to the gaming section 3 as shown in FIG. 5, and includes a dice releasing unit 103*a* which releases the dice D4, a rolling plate 103*b* which rolls the dice D4 released from the dice releasing unit 103*a*, and a stop plate 103*c* which finally stops the dice rolling on the rolling plate 103*b*.

The rolling plate 103*b* is formed into a so-called cone shape which gradually slopes down to the inner side from the outer frame of the circular shape, and on the surface thereof, the dice rolls. In detail, in a part of the rolling plate 103*b*, an air hole 103*d* through which air is introduced is formed, and by introducing air from the air hole 103*d* via an air blowing mechanism 103A concurrently with the start of gaming, the released dice D4 rolls on the rolling plate 103*b*.

The stop plate 103*c* is formed into a circular plate on the bottom of the cone-shaped rolling plate 103*b*, and is a range in which the dice D4 that rolls on the rolling plate 103*b* drops along the slope of the rolling plate according to the stop of the air introduction and finally stops. That is, the dice D4 released from the dice releasing unit 103*a* rolls on the surfaces of the rolling plate 103*b* and the stop plate 103*c* according to air introduction from the air blowing mechanism 103A, and according to stop of the air introduction, drops along the slope surface of the rolling plate 103*b* and finally stops on the stop plate 103*c*.

The stop plate 103*c* is driven to slide by the stop plate driving motor 103B as shown in FIG. 5, and by driving the stop plate 103*c* to slide, the dice D4 drops toward the collect/release mechanism 110 while colliding with the contact portion 103*b*' formed on the bottom of the rolling plate 103*b*.

The collect/release mechanism 110 includes an accommodation unit 110*a* which accommodates the dice dropping from the stop plate 103*c*, a conveyance mechanism 110*b* which conveys the dice in the accommodation unit 110*a* toward the dice releasing unit 103*a*, and a conveyance driving motor 103C which drives the conveyance mechanism 110*b*. In this case, the structure of the collect/release mechanism 110 is not specifically limited as long as the collect/release mechanism 110 is constructed so as to collect the dice after the rolled number on the dice stopped on the stop plate 103*c* is detected by the rolled number detecting device 115, and release the dice toward the rolling plate 103*b* from the dice releasing unit 103*a*.

In this conveyance mechanism 110*b*, an accommodation unit (not shown) which accommodates two dice is installed, and when a bonus game described later is performed, in addition to the dice D4, the accommodated two dice are also released from the dice releasing unit 103*a*.

The upper side of the player gaming section 110 is entirely covered by a transparent acrylic cover member 112, whereby the rolling range of the dice is restricted.

Rolled numbers on the dice that roll in the gaming section 3 and the player gaming section 110 and finally stop on the stop plates 3*c* and 103*c* are identified by a rolled number detecting device.

Figure 6:
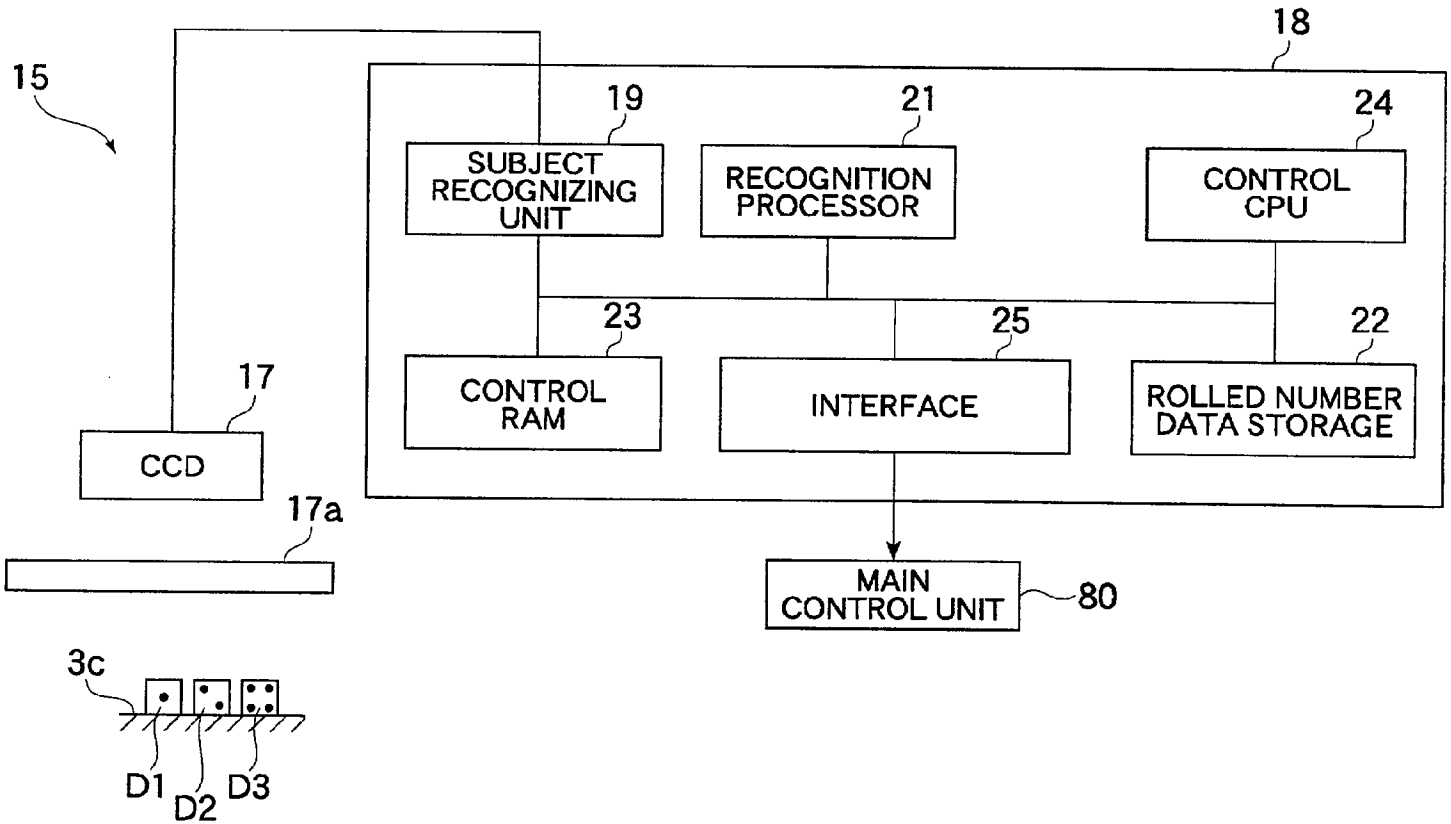
FIG. 6 is a block diagram showing an example of a rolled number detecting device.

In the gaming section 3, a rolled number detecting device 15 for detecting stop rolled numbers on the respective dice is installed on the top of the cover member 12. The rolled number detecting device 15 of this embodiment includes, as shown in the block diagram of FIG. 6, an image pickup device (CCD camera) 17 which takes an image of the dice as a subject, and a rolled number detecting circuit 18 which detects the rolled numbers on the respective dice by processing an imaging signal from the image pickup device.

The focal point of the image pickup device 17 is set on the stop plate 3*c* in advance by the focal lens 17*a* so as to take an image of the dice on the stop plate 3*c*, and is controlled in exposure. The rolled number detecting circuit 18 includes a subject recognizing unit 19 which recognizes a position of a subject (dice) by receiving an imaging signal from the image pickup device, a recognition processor 21 which identifies rolled numbers on the respective dice, a rolled number data storage 22 storing comparison data on rolled numbers on the dice, a control RAM 23, and a controlling CPU 24 which controls these, and these units are connected via a bus and each unit is structured so as to be controlled by the controlling CPU 24.

Figure 7:
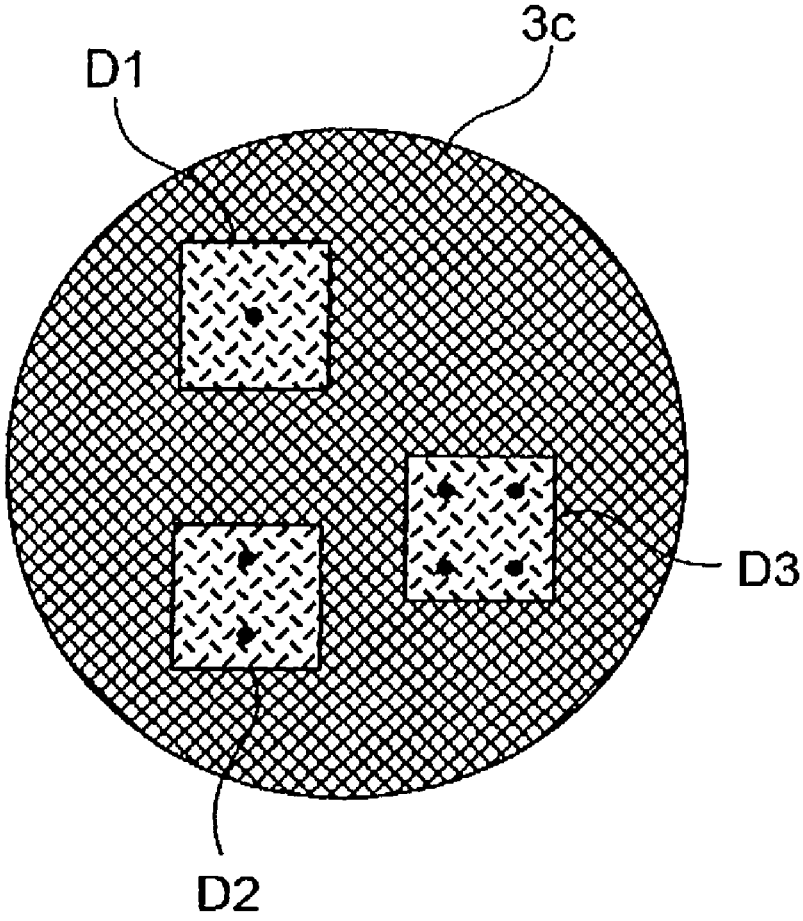
FIG. 7 is a drawing showing an imaging example of dice obtained in the rolled number detecting device shown in FIG. 6.

In detail, an imaging signal of a dice whose image is formed on the image pickup device 17 is measured in intensity distribution of the image at the subject recognizing unit 19. As schematically shown in FIG. 7, by measuring the intensity distribution, the positions (surface states) of the dice D1, D2, and D3 on the stop plate 3*c* can be identified. The three dice identified herein are subjected to comparison processing for comparing with rolled number patterns (six number patterns) stored in advance in the rolled number data storage 22, and thereby, rolled numbers exposed on the respective dice are identified.

Thereby, number information identified for the respective three dice is stored in the control RAM 23 and transmitted to a main control unit described later via an interface 25 when game media payout processing is performed. That is, the rolled number detecting device 15 detects rolled numbers on the respective three dice D1, D2, and D3 stopping in the gaming section 3, and transmits the rolled number information to the main control unit which controls the entirety of the dice game machine.

In the player gaming section 100, on the lower side of the stop plate 103*c*, a rolled number detecting device 115 having an identification sensor is installed. The stop plate 103*c* is made of a translucent material, and light is irradiated toward the dice from a light projector of the identification sensor and reflected light thereof is detected, whereby the rolled number on the surface side of the dice is identified. Also in the player gaming section 100, a rolled number on the dice may be detected by the same mechanism as the rolled number detecting device 15, or the detection method can be appropriately varied, for example, the rolled number is detected by a magnetic method.

Next, constructions of the controller 6 and the image display device 7 will be described.

The controller 6 is provided on the side of the image display device 7 of the player terminal 4 as shown in FIG. 2, and buttons to be operated by a player are arranged thereon. In detail, in order from the left side viewed from a position facing the player terminal 4, a BET determining button 30, a CASH-OUT button 31, and a HELP button 32 are arranged.

The BET determining button 30 is a button to be depressed for determining a BET after a BET operation by the image display device 7. When a BET is determined and made on a region corresponding to the rolled numbers on the respective dice in the gaming section 3 during gaming, winning is won. In the case of winning, based on a payout table, credits corresponding to a number of bet chips are added to current credits that the player has.

The CASH-OUT button 31 is normally a button to be depressed when finishing a game, and when the CASH-OUT button 31 is depressed, game media corresponding to credits that a current player acquired by gaming and has are paid out from the payout opening 8.

The HELP button 32 is a button to be depressed when the game operation method is unknown, and when the HELP button 32 is depressed, a HELP image screen showing various operation information is immediately displayed on the image display device 7.

The image display device 7 is, as shown in FIG. 1, a so-called touch-panel type liquid crystal display having a touch panel 35 attached to the front face thereof, and icons displayed on a liquid crystal display surface 36 can be selected by pushing the icons with a finger or the like.

FIG. 1 is a drawing showing an example of a display screen to be displayed on the image display device 7 during gaming. As shown in this figure, during gaming of the dice game machine 1, on the image display device 7, a table betting board for predicting rolled numbers on the respective dice D1, D2, and D3 rolled in the gaming section 3 and predicting a rolled number on the dice D4 rolled in the player gaming section 100 of a current game is displayed. A player can perform a BET operation by using his/her credits while looking at a BET screen 40 displayed on the image display device 7.

Herein, the BET screen 40 will be described in detail.

On the BET screen 40, a BET area 41 in which dice are displayed is displayed arranged in a grid-like manner, and a BET operation is performed by designating the BET area 41 by pushing (touching) the touch panel 35 with a finger and displaying a chip on the designated portion. This BET area 41 is an area for performing a BET operation predicting rolled numbers on three dice D1, D2, and D3 rolled in the gaming section 3.

On the lower side of the BET screen 40, in order from the left side of the screen, a unit BET button 43, a CASH-OUT result display area 45, and a credit number display area 46 are displayed.

The unit BET button 43 is for betting a chip on the BET area 41 that a player designated. The unit BET button consists of four buttons of a 1-BET button 43A, a 5-BET button 43B, a 10-BET button 43C, and a 100-BET button 43D. When a BET operation is failed, the BET operation can be performed again by touching the Re-BET button 43E.

The player designates a BET portion in the BET area 41 to be bet on with a cursor 47 by directly pushing the screen with a finger or the like. In this state, when depressing the 1-BET button 43A, chips can be bet one by one (the number of chips bet is increased in the order of "1," "2," "3" . . . each time of pushing the 1-BET button 43A with a finger). Similarly, by pushing the 5-BET button 43B, chips can be bet in increments of 5 (the number of chips bet is increased in the order of "5," "10," "15" . . . each time of pushing the 5-BET button 43B with a finger), and by pushing the 10-BET button 43C, chips can be bet in increments of 10 (the number of chips bet is increased in the order of "10," "20," "30" . . . each time of pushing the 10-BET button 43C), and further, by pushing the 100-BET button 43D, chips can be bet in increments of 100 (the number of chips bet is increased in the order of "100," "200," "300" . . . each time of pushing the 100-BET button 43D with a finger or the like). In the BET area 41, the number of chips bet until the current time point is displayed as a chip mark 48, and the number indicated on the chip mark 48 shows the number of chips bet.

On the CASH-OUT result display area 45, a number of bet chips and a number of credits to be refunded to the player in the previous game are displayed. A number obtained by subtracting the number of bet chips from the number of refunded credits is a credit number newly acquired by the player in the previous game.

Further, on the credit number display area 46, a current credit number that the player has is displayed. When chips are bet, this credit number decreases according to the number of bet chips (1 credit corresponds to 1 chip). When bet chips are won and credits are refunded, the credit number increases by the refunded number. When the credit number that the player has reaches zero, the game is finished.

On the upper side of the BET screen 40, a bar-shaped BET timer graph 49 is provided. The BET timer graph 49 is a graph indicating the remaining time during which the player can bet, and a red graph gradually extends rightward since the start of the game, and when it extends to the rightmost side, the time during which betting is possible in the current game ends. In each player terminal 4, when the BET time of the player ends, the dice D1 through D3 are successively thrown from the dice releasing unit 3*a* to the rotary plate 3*b*.

Herein, the BET area 41 of the BET screen 40 will be described. The BET area 41 includes a plurality of BET portions, and by chipping the BET portion, a BET operation is performed.

In the drawing, the BET portions 41A and 41B are portions to be bet on by predicting a total value of the dice D1 through D3. That is, when it is predicted that the total value is 4 through 10, the BET portion 41A is selected, and when it is predicted that the total value is 11 through 17, the BET portion 41B is selected. The award ratio is set to 1 to 1 (two chips are paid out for one chip bet), when the total value is 3 or 18 (the combination of 1, 1, and 1 or 6, 6, and 6), the player loses.

The BET portion 41C is a portion to be bet on by predicting that rolled numbers on two of the three dice will become equal to each other. That is, the BET portion 41C is a portion to be bet on by predicting that any of (1, 1), (2, 2), (3, 3), (4, 4), (5, 5), and (6, 6) will appear among the three dice, and its award ratio is set to 1 to 10.

The BET portion 41D is a portion to be bet on by predicting that rolled numbers on three dice rolled will be all the same. That is, the BET portion 41D is a portion to be bet on by predicting that any of (1, 1, 1), (2, 2, 2), (3, 3, 3), (4, 4, 4), (5, 5, 5), and (6, 6, 6) will appear on the three dice, and the award ratio is set to 1 to 30.

The BET portion 41E is a portion to be bet on by predicting that the rolled numbers on the three dice rolled will be all the same and predicting the number. That is, the BET portion 41E is a portion to be bet on by predicting that any of (1, 1, 1), (2, 2, 2), (3, 3, 3), (4, 4, 4), (5, 5, 5), and (6, 6, 6) will appear on the three dice and predicting any of the numbers, and the award ratio is set to 1 to 180.

The BET portion 41F is a portion to be bet on by predicting a total value of the three dice. The award ratio is set according to the appearance frequency of the total value, and when the total value is 4 or 17, the award ratio is set to 1 to 60, when the total value is 5 or 16, the award ratio is set to 1 to 30, when the total value is 6 or 15, the award ratio is set to 1 to 18, when the total value is 7 or 14, the award ratio is set to 1 to 12, when the total value is 8 or 13, the award ratio is set to 1 to 8, when the total value is 9 or 12, the award ratio is set to 1 to 7, and when the total value is 10 or 11, the award ratio is set to 1 to 6.

The BET portion 41C is a portion to be bet on by predicting that rolled numbers on two of the three dice will become equal to each other, and the award ratio is set to 1 to 5.

The BET portion 41H is a region to be bet on by predicting rolled numbers on the dice, and its award ratio is set according to the numbers of dice the rolled numbers on which match predicted numbers. For example, when betting is performed by predicting the rolled number "1" and the resultant rolled numbers on the three dice include one "1," the award ratio is set to 1 to 1, when they include two "1", the award ratio is set to 1 to 2, and when they include three "1," the award ratio is set to 1 to 10.

Below the BET area 41, a BET area 61 for a BET operation predicting rolled numbers on dice rolled in the player gaming section 100 is provided. That is, under conditions that the rolled numbers on three dice in the gaming section and the rolled number on one dice in the player gaming section 100 are in a predetermined combination and a player who is gaming with the corresponding player terminal performed a BET operation predicting this predetermined combination, the player can receive a special award different from the normal award.

Hereinafter, the BET area 61 will be described in detail.

The BET area 61 includes a dice selection portion 61*a* in which dice are displayed so that a rolled number on one dice rolled in the player gaming section 100 installed in the player terminal is predicted, and a no-selection area 61*b* in which such prediction is not performed, and a player can select a rolled number on one dice D4 rolled in the player gaming section 100 (up to 4 numbers are selectable as predicted numbers) by touching the touch panel 35 with a finger. That is, when the player predicts a rolled number on the dice D4 rolled in the player gaming section 100 of the corresponding player terminal 4 and a resultant rolled number on the dice D4 stopped matches the predicted number, the player can receive a special award in addition to an award that the player acquires when he/she bet on the BET area 41 and wins.

In detail, for example, when one number is predicted as a rolled number on the dice D4 and the actual rolled number on the dice in the player gaming section 10 matches the prediction, an award 6 times as much as the normal award can be acquired. For example, when a player has placed a chip on the BET portion 41D of the BET area 41 and (1, 1, 1) appear as resultant rolled numbers on the dice rolled in the gaming section 3, the player can acquire an award 6 times as much as a gaming value that is obtained at a normal award ratio of 1 to 30.

Similarly, in the dice selection portion 61*a*, when two numbers are predicted for the dice D4 and the rolled number on the dice rolled in the player gaming section 100 actually matches the prediction, an award 3 times as much as normal can be acquired, and when three numbers are predicted for the dice D4 and the rolled number on the dice rolled in the player gaming section 100 actually matches the prediction, an award 2 times as much as normal can be acquired, and when four numbers are predicted for the dice D4 and the rolled number on the dice rolled in the player gaming section 100 actually matches the prediction, an award 1.5 times as much as normal can be acquired (decimal fraction is truncated). Up to four numbers can be predicted for the dice D4, and if this prediction is not realized, an award 0.7 times as much as normal is provided (decimal fraction is truncated).

The result of selection made by a player is lit up on the display (in the example shown in the drawing, a display example in which "1" is predicted as the rolled number on the dice D4 is shown), and by touching the determination button 61D when the selection is finished, any in the ratio changing area 61F on the right side is lit up on the display (in the example shown in the drawing, one "1" is selected as a rolled number on the dice D4 so that the portion of 6 times is lit up). During the BET operation, to make re-selection, the delete button 61E is touched. When the rolled number on the dice D4 is not predicted, it is required that the no-selection area 61*b* is touched or the dice selection portion 61*a* is not touched during a BET time, and in this case, the player can acquire a normal award of the gaming performed in the gaming section 3.

According to the dice game machine 1 constructed as described above, in the player terminal 4, a player gaming section 100 exclusive to a player who performs a BET operation is installed, and the player can predict a rolled number on one dice D4 rolled in the player gaming section 100 installed in the player terminal 4 in addition to prediction of rolled numbers on the dice D1, D2, and D3 rolled in the gaming section 3, so that the objects to be bet on can be increased. That is, in comparison with a conventional dice game machine using three dice, the rolled number on a dice rolled in the player gaming section 100 installed in the player terminal 4 can also be predicted as well as prediction of rolled numbers of the three dice D1, D2, and D3 rolled in the normal gaming section, so that the BET patterns can be increased accordingly, and along with this, the rolled numbers to appear on the dice also increase, so that a high award ratio can be set, so that amusement can be improved.

In the dice game machine of this embodiment, when rolled numbers on the three dice D1, D2, and D3 rolled in the gaming section 3 and a rolled number on one dice D4 rolled in the player gaming section 100 satisfy predetermined conditions, in the corresponding player terminal, a bonus game in which a large amount of game media can be acquired is performed.

Further, the dice game machine of this embodiment has a so-called progressive bonus function (jackpot) by which, in addition to the bonus game, each time a BET operation is performed from the player terminals 4, a part of the BET (for example, 1 to 3 percent of the total BET amount) is saved, and when predetermined conditions are satisfied, saved game media are paid to the player terminal that satisfied the conditions.

Hereinafter, a bonus game and a progressive bonus function to be performed in the dice game machine of this embodiment will be described.

The conditions set for enabling a bonus game (conditions for transition to a bonus game) in this embodiment are that the rolled numbers on the dice D1, D2, and D3 stopped in the gaming section 3 are all the same, the player predicted this result and bet (bet on the BET portion 41D and/or the BET portion 41E), and the rolled number on the dice D4 stopped in the player gaming section 100 is the same as that of the dice D1, D2, and D3 (rolled numbers on the four dice are all the same).

As described above, when the predetermined conditions are satisfied, the player can perform a bonus game which allows the player to acquire a large amount of game media, however, the bonus game is performed by a part of the player terminals in a time between a gaming operation in the gaming section 3 and the next gaming operation, and therefore, it is preferable that the game mode of the bonus game is set so that a result can be obtained in a comparatively short time.

The bonus game of this embodiment is performed in the player gaming section 100 of a corresponding player terminal 4, and when the bonus game is enabled, three dice are released in the player gaming section 100, and without a BET operation by a player, all BET portions 41A through 41H of the BET area 41 are validated in a state that one chip is bet.

Therefore, in the bonus game, a plurality of winning results are obtained according to the results of rolled numbers on three dice in the player gaming section 100, and the player can acquire a large amount of game media depending on the combination of the rolled numbers on the three dice.

The progressive bonus is enabled when a lottery performed in the main control unit 80 which controls operations of the dice game machine described later is won.

The lottery is performed under conditions that the rolled numbers on the dice D1, D2, and D3 stopped in the gaming section 3 are all the same, a player predicted this result and bet (bet on the BET portion 41D and/or the BET portion 41E), the dice D4 stopped in the player gaming section 100 is the same as that on the dice D1, D2, and D3 (rolled numbers on the four dice are the same), and this resultant number was selected in the dice selection portion 61*a* of the BET area 61.

That is, when the conditions are satisfied, the player is allowed to receive a special award according to selection in the BET area 61, and is allowed to perform the bonus game, and is further allowed to obtain a progressive bonus of a lottery. In this case, the winning probability of the progressive bonus is appropriately set by lottery processing to be performed in the main control unit 80 described later.

The bonus game may be performed combined with a progressive bonus function. That is, the payout processing in the bonus game enabled under predetermined conditions may be performed by using game media saved according to BET operations from the respective player terminals 4. The dice game machine may also not have the progressive bonus function.

Figure 8:
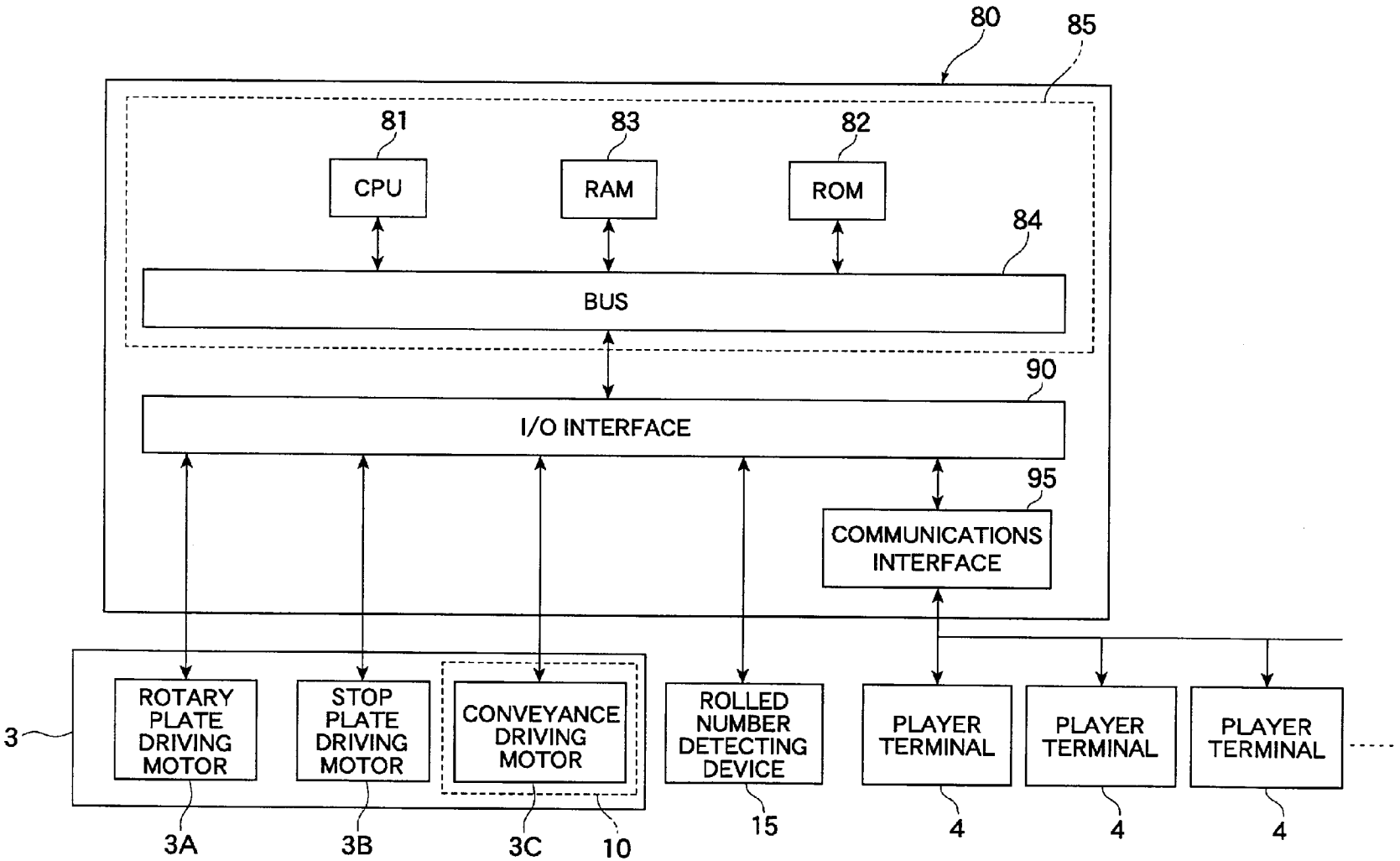
FIG. 8 is a block diagram schematically showing a control system of the dice game machine.

Next, a construction of a control system of the dice game machine 1 described above will be described with reference to FIG. 8. FIG. 8 is a block diagram schematically showing a control system of the dice game machine.

The main control unit 80 of the dice game machine 1 includes a microcomputer 85 which mainly consists of a main controlling CPU 81, a ROM 82, a RAM 83, and a bus 84 which performs data transfer among these components.

The CPU 81 is connected to various devices for driving the gaming section 3, specifically, a rotary plate driving motor 3A, a stop plate driving motor 3B, and a conveyance driving motor 3C as a main driver of the dice collect/release mechanism 10, etc., via an I/O interface 90. To the I/O interface 90, the above-described rolled number detecting device 15 is connected, and to and from the rolled number detecting device 15, the I/O interface transmits and receives signals indicating that the gaming operation is finished and signals relating to the rolled numbers on three dice stopped on the stop plate 3*c*. Further, to the I/O interface 90, a communication interface 95 is connected, and via this communication interface 95, to and from the respective player terminals 4, the main control unit 80 transmits and receives various data including BET information, award information, and control information of the player gaming sections 100 installed in the respective player terminals.

The ROM 82 in the main control unit 80 consists of, for example, a semiconductor memory, etc., and stores programs for realizing basic functions of the dice game machine 1, specifically, a program for controlling various devices driving the gaming section 3, a program for realizing the progressive function, a program for directively controlling the respective player terminals 4, and so on, and stores a payout table or the like to be referred to when performing the dice game.

The RAM 83 is a memory for temporarily storing various data computed in the CPU 81. For example, the RAM 83 temporarily stores chip BET information transmitted from the respective player terminals, number information on a rolled number on the dice D1 transmitted from the rolled number detecting device 115 as a gaming result in the player gaming sections 100 installed in the respective player terminals 4, BET accumulation information on BET amounts accumulated in a predetermined percentage of chips transmitted from the respective player terminals 4, number information on rolled numbers on the respective dice D1 through D3 transmitted from the rolled number detecting device 15 as gaming results in the gaming section 3, and data concerning the results of processing performed by the CPU 81.

The CPU 81 executes control processing along with the progress of gaming, specifically, controls the rotary plate driving motor 3A driving the gaming section 3, the stop plate driving motor 3B, and the conveyance driving motor 3C based on data and programs stored in the ROM 82 and the RAM 83, throws the dice onto the rotary plate 3*b* of the gaming section 3, and collects the dice from the stop plate 3*c* and conveys the dice toward the dice releasing unit 3*a* so that the dice can be thrown again, and confirms the rolled numbers on the dice stopped on the stop plate 3*c*.

The CPU 81 has a function for transmitting and receiving data to and from the respective player terminals 4 and advancing the gaming by directively controlling the respective player terminals 4 in addition to the control processing along with the progress of gaming. In detail, the CPU receives BET information transmitted from the respective player terminals 4, controls the driving of various drive members (air blowing mechanism 103A, driving motors 103B and 103C, and rolled number detecting device 115, etc.,) in the player gaming section 100 installed in each player terminal 4, and performs winning judgment of bet chips based on rolled numbers on the dice D1, D2, D3, and D4 as the results of gaming and BET information transmitted from each player terminal 4, and calculates a number of credits to be paid out in each player terminal 4 by referring to the payout table.

When performing the above-described winning judgment processing, to perform judgment processing as to whether the bonus game was acquired and perform the bonus game for a specific player terminal that acquired the bonus game, the CPU 81 performs driving control of the various driving members of the player terminal and performs winning judgment processing based on rolled numbers on the dice as a result of the bonus game in the player gaming section 100, and calculates the number of credits to be paid out to the player terminal for which the bonus game was performed by referring to the payout table.

Furthermore, the CPU 81 executes lottery processing of the above-described progressive bonus. This is enabled in any of the player terminals under conditions that, as described above, the rolled numbers on the dice D1, D2, and D3 stopped in the gaming section 3 are all the same, a player made a BET predicting this result (bet on the BET portion 41D and/or the BET portion 41E), and the dice D4 stopped in the player gaming section 100 is the same as that on the dice D1, D2, and D3 (rolled numbers on the four dice are all the same), and the player selected only this resultant number in the dice selection portion 61*a*.

The lottery can be performed by, for example, extracting arbitrary random numbers by connecting a random number generating circuit or a sampling circuit to the CPU 81 or by sampling random rolled numbers on the operation program of the CPU 81, and is not limited to a specific method. Alternatively, it is also allowed that the player performs a separate special game and is made to win depending on the result of this game.

Next, a construction of the control system of the player terminal 4 connected to the CPU 81 of the main control unit 81 will be described.

Figure 9:
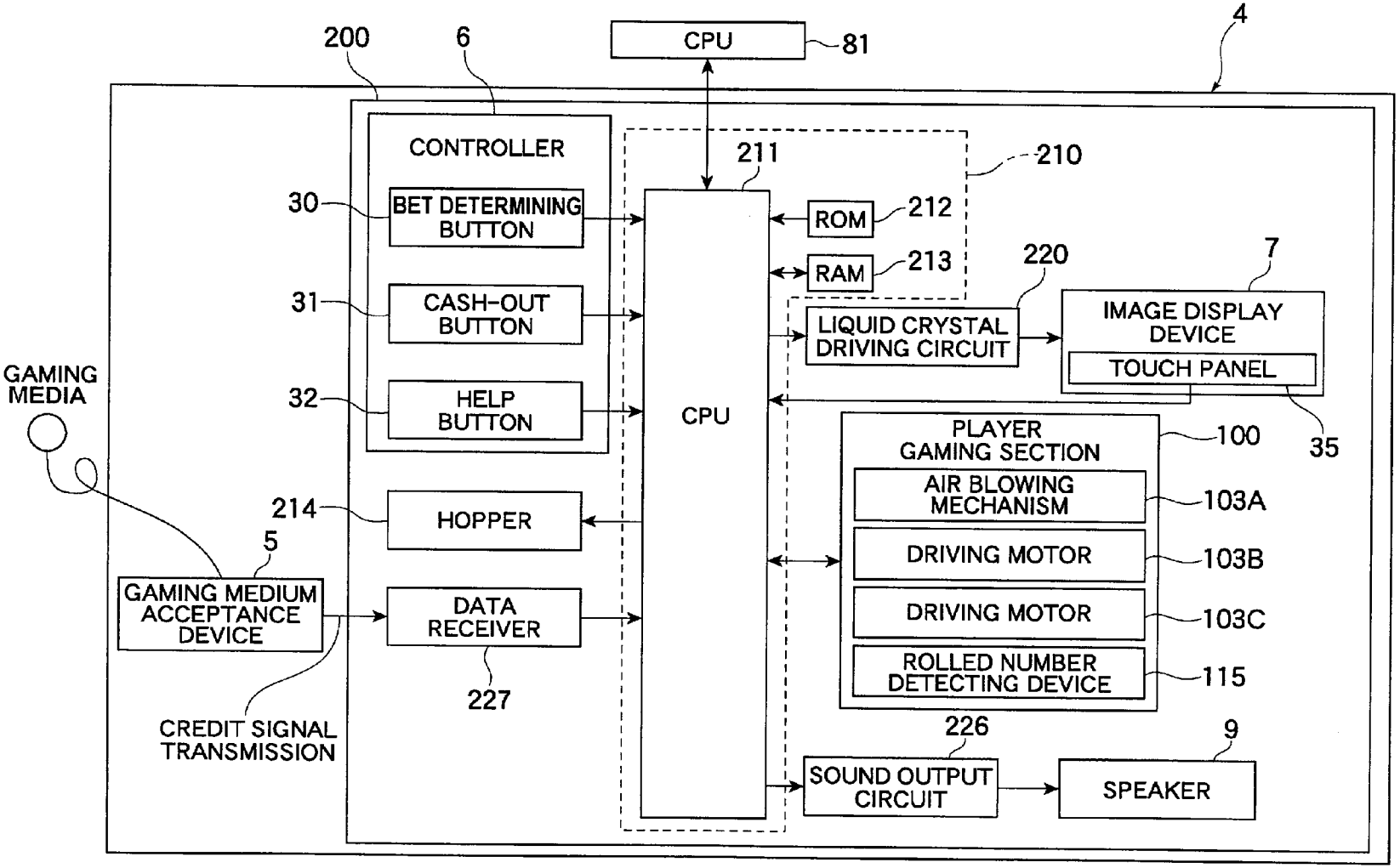
FIG. 9 is a block diagram schematically showing a control system of a player terminal.

FIG. 9 is a block diagram schematically showing the control system of the player terminal 4 according to the embodiment.

The player terminal 4 includes a main body 200 provided with an image display device 7 and a player gaming section 100, etc., and a game medium acceptance device 5 attached to the main body 200. Furthermore, the main body 200 includes a player terminal control unit 210, and several peripheral devices.

The player terminal control unit 210 includes a player terminal controlling CPU 211, a ROM 212, and a RAM 213.

The ROM 212 consists of, for example, a semiconductor memory, etc., and stores programs for realizing basic functions of the player terminal 4, other various programs necessary for controlling the player terminal 4, and a data table, etc.

The RAM 213 is a memory for temporarily storing various data computed in the CPU 211, a number of credits that the player currently has, and a chip BET status by the player.

To the CPU 211, the BET determining button 30, the CASH-OUT button 31, and the HELP button 32 provided on the controller 6 (see FIG. 2) are connected. Then, the CPU 211 performs control so as to execute various operations in response to operation signals outputted according to depressing on the respective buttons. In detail, based on input signals supplied from the controller 6 in response to inputs of player's operations and data and programs stored in the ROM 212 and the RAM 213, the CPU 211 executes various processing and transmits the results of processing to the CPU 81 of the main control unit 80 described above.

Furthermore, the CPU 211 receives a command signal from the CPU 81 of the main control unit 80 and controls the peripheral devices of the player terminal 4, specifically, peripheral devices (the air blowing mechanism 103A, the driving motors 103A and 103B, and the rolled number detecting device 115) for driving the player gaming section 100 and advances the dice game performed in the player gaming section 100 in the player terminal 4.

Depending on the contents of the processing, the CPU 211 executes various processing based on input signals supplied from the controller 6 when a player's operation is inputted and data and programs stored in the ROM 212 and RAM 213, and based on the results of processing, controls the peripheral devices of the player terminal 4 and advances the dice game in the player terminal 4. It is set for each processing which of the methods is used according to the contents of the processing. For example, game media payout according to rolled numbers on the dice is according to the former method, and BET operation processing by the player is according to the later method.

To the CPU 211, a hopper 214 is connected, and in response to a command signal from the CPU 211, the hopper 214 pays out a predetermined number of game media from the payout opening 8.

Further, to the CPU 211, the image display device 7 is connected via a liquid crystal driving circuit 220. The liquid crystal driving circuit 220 includes a program ROM, an image ROM, an image control CPU, a work RAM, a VDP (video display processor), and a video RAM, etc. The program ROM stores image controlling programs and various selection tables relating to display on the image display device 7, and the image ROM stores dot data for forming an image to be displayed on the image display device 7. The image control CPU determines an image to be displayed on the image display device 7 among dot data stored in advance in the image ROM based on parameters set in the CPU 211 according to an image control program stored in advance in the program ROM. The work RAM is constructed as a temporary storing unit when the image control program is executed by the image control CPU. The VDP forms an image corresponding to the display contents determined by the image control CPU and outputs it to the image display device 7. The video RAM is constructed as a temporary storing unit when an image is formed in the VDP.

To the front face of the image display device 7, as described above, the touch panel 35 is attached, and operation information of the touch panel 35 is transmitted to the CPU 211. The touch panel 35 detects a BET operation of chips by a player on the above-described BET screen 40. In detail, selection in the BET area 41 and the BET area 61 of the BET screen 40 and an operation on the unit BET button 43 are performed by touching the touch panel 35, and information of these is transmitted to the CPU 211. Based on the information, current BET information of the player (BET areas 41 and 61 designated on the BET screen 40 and the number of chips bet) is stored in the RAM 213 as appropriate. Further, the BET information is transmitted to the CPU 81 of the main control unit 80 and stored in a BET information storage area of the RAM 83.

Further, a sound output circuit 226 and a speaker 9 are connected to the CPU 211, and the speaker 9 generates various effect sounds for providing various effects based on an output signal from the sound output circuit 226. To the CPU 211, a game medium acceptance device 5 for inserting game media such as coins or medals is connected via a data receiver 227. The data receiver 227 receives a credit signal transmitted from the game medium acceptance device 5 and the CPU 211 increases the number of credits of the player stored in the RAM 213 based on the transmitted credit signal.

Next, control operations of the dice game machine 1 constructed as described above will be described based on player's operations when playing the game with the player terminal 4.

Figure 10:
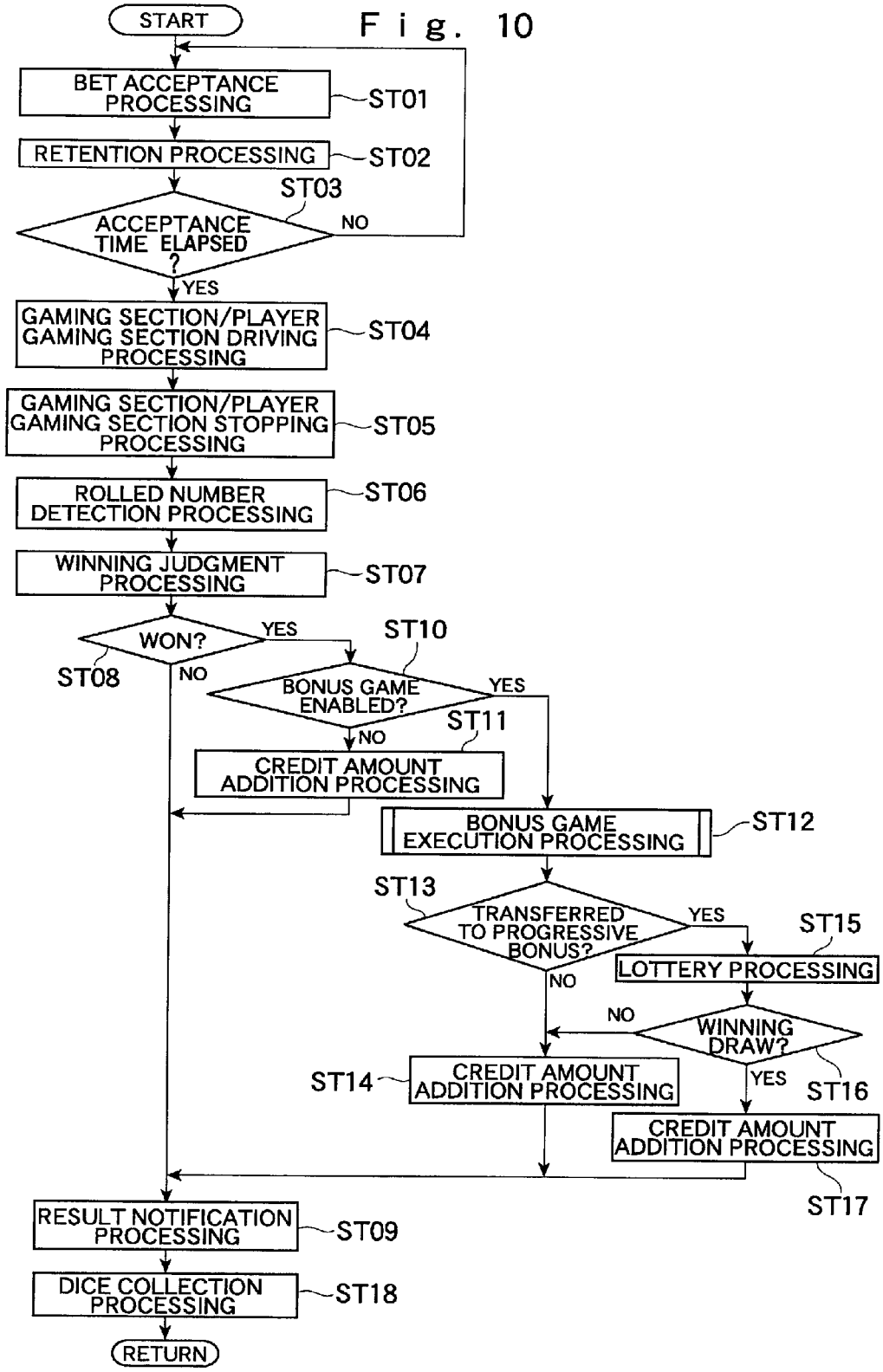
FIG. 10 is a flowchart showing control operations of procedures of a dice game performed between a main control unit and a player terminal of the dice game machine.

FIG. 10 is a flowchart showing control operations of procedures of a dice game to be performed between the main control unit 80 and the player terminal 4 of the dice game machine 1.

First, in the dice game machine 1, BET acceptance processing is performed (Step ST01). During this BET acceptance processing, a player sitting at the player terminal 4 inserts game media such as coins or medals into the game medium acceptance device 5, and performs the above-described BET operation while looking at the BET screen 40 (see FIG. 1). During the BET acceptance processing, on the BET screen 40 in each player terminal, a BET timer graph 49 is displayed, and the main control unit 80 accepts the BET operation within the time of the graph. In the credit number display area 46 of the BET screen 40, by each BET operation, the number of chips (remaining chips) that can be bet is displayed after being subtracted.

In the above-described BET operation, the player can perform a BET operation only predicting rolled numbers on the three dice in the gaming section 3 (makes a BET on the BET area 41), and in addition, can perform a BET operation predicting a rolled number on one dice in the player gaming section 100 installed in the player terminal (make a BET on the BET area 61). That is, in the BET area 41, a BET operation conforming to the rules of normal Sic BO (a BET operation on only rolled numbers on the three dice in the gaming section 3) can be performed, and a player can perform a BET operation on the BET portions 41A through 41G according to the above-described operation method. On the portion that the player bet on, a chip mark 48 is displayed as shown in FIG. 1.

When the player still wants to perform a BET operation predicting a rolled number on the dice in the player gaming section 100, the player touches any (one through four can be selected) of six dice indications in the BET area 61. A dice selected by the player lights, according to the selected number, when the bet portion in the BET area 41 is won, an award in the BET area 41 changes (1.5 through 6 times). Although the player made a selection, if the rolled number on the dice in the player gaming section 100 was not the same as the predicted number, it results in a loss for the player, and even if the bet portion in the BET area 41 is won, the award changes to 0.7 times and is paid out.

When accepting the above-described BET operations from the respective player terminals, the main control unit 80 writes the contents of the BETs onto a predetermined storage area of the RAM 83 for each player terminal, and saves apart (for example, 1 through 3 percent) of the BETs (ST02). The saved BET amount (amount of game media) is written on a predetermined storage area of the RAM 83.

The above-described operation is executed until the BET acceptance time elapses (ST03), and when the BET acceptance time ends, the CPU 81 of the main control unit 80 transmits a drive signal to the gaming section 3 and the player gaming section 100 (CPU 211 of the player terminal) to drive the gaming section 3 and the player gaming section 100 (ST04). At this time, in the gaming section 3, three dice D1 through D3 roll, and in the player gaming section 100 in the player terminal 4 in which a player performed a BET operation, one dice D4 rolls. If the player is not sitting or does not perform a BET operation in the BET area 61 shown in FIG. 1, the player gaming section 100 may not be driven.

Then, after a predetermined time elapses, the gaming section 3 and the player gaming section 100 are subjected to stop (ST05), and in this state, rolled number detection processing is performed (ST06). In the rolled number detection processing in the gaming section 3, the above-described rolled number detecting device 15 is driven, and in the player gaming section 100, the rolled number detecting device 115 is driven, whereby information on numbers exposed on the surfaces of the dice is detected. Number information of the respective dice is transmitted to the main control unit 80, and the CPU 81 executes winning judgment processing based on the number information and BET information of the respective player terminals stored in the RAM 83 (ST07).

At this time, when winning is not judged (ST08: No), it is a loss for the player, and this result is transmitted to the player terminal (ST09). In each player terminal, on the payout result display area 45 of the BET screen 40, result display processing for displaying "LOSS," etc., is performed. Then, when a bonus game is not enabled in all player terminals, to transfer to the next game, the CPU 81 of the main control unit 80 drives the collect/release mechanism 10, 110 to collect the dice on the stop plate 3*c*, 103*c* (ST18), whereby one game is ended.

In the winning judgment processing, when winning is judged, it is subsequently judged whether a bonus game has been enabled (ST08: YES, ST10). The conditions for enabling the bonus game are that, as described above, the rolled numbers on the dice D1, D2, and D3 stopped in the gaming section 3 are all the same, the player predicted this result and bet (bet on the BET portion 41D and/or BET portion 41E), and the rolled number on the dice D4 stopped in the player gaming section 100 is the same as that on the dice D1, D2, and D3 (the rolled numbers on the four dice are all the same).

When the bonus game is not won (ST10: NO), an award amount is calculated by referring to a predetermined payout table (credit amount addition processing: ST11), and a result of this calculation is stored in a predetermined work area of the RAM 83 and then a winning judgment signal is transmitted to each player terminal 4 (ST09). The CPU 211 of each player terminal 4 drives and controls the liquid crystal driving circuit 220 based on the winning judgment signal transmitted from the main control unit 80, and updates the payout result display area 45 and the credit number display area 46 displayed on the BET screen 40. The CPU 211 of each player terminal 4 drives the liquid crystal driving circuit 220 and the sound output circuit 226 to provide effects of images and sounds as appropriate.

On the other hand, when the bonus game is won (ST10: YES), bonus game execution processing is directly performed (ST12) and it is judged whether the process transfers to a progressive bonus (ST13). The conditions for transferring to the progressive bonus are that, as described above, the rolled numbers on the dice D1, D2, and D3 stopped in the gaming section 3 are all the same, the player predicted this result and bet (bet on the BET portion 41D and/or BET portion 41E), the rolled number on the dice D4 stopped in the player gaming section 100 is the same as that of the dice D1, D2, and D3 (when the rolled numbers on the four dice are all the same), and as this rolled number only one number was selected in the dice selection portion 61*a* of the BET area 61.

Figure 11:
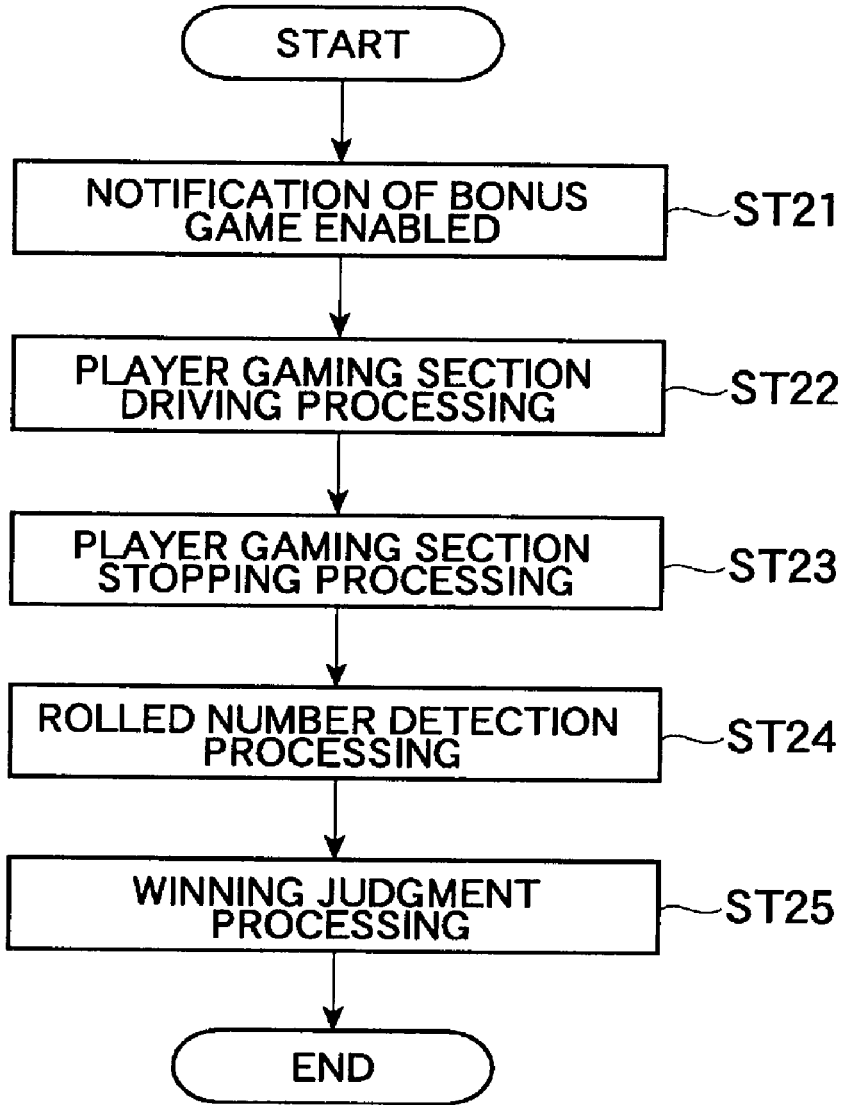
FIG. 11 is a flowchart showing processing procedures when performing a bonus game.

First, the above-described bonus game processing notifies the player terminal of the bonus game being enabled as shown in the flowchart of FIG. 11 (ST21). When the player terminal receives this enabling signal, the CPU 211 of the player terminal 4 performs validation processing of the BET area 41 on the BET screen 40. That is, this validation processing creates a state that one chip is bet in all regions of the BET area 41 of the BET screen 40. It is also allowed that when receiving an enabling signal, a special effect may be separately provided on the image display device 7, etc.

Subsequently, the CPU 81 of the main control unit 80 transmits a drive signal to the player gaming section 100 (CPU 211 of the player terminal) for which a bonus game is enabled to drive the player gaming section 100 (ST22). At this time, into the player gaming section 100, two new dice are thrown (a total of three dice rolled including the dice that has been already thrown), and the player can play one dice game without a BET operation (without consuming game media).

Then, after a predetermined time elapses, the player gaming section 100 is subjected to stop (ST23), and in this state, rolled number detection processing is performed (ST24). In this rolled number detection processing, the rolled number detecting device 115 is driven to detect information on numbers exposed on the surfaces of the three dice. Then, the number information of the respective dice is transmitted to the main control unit 80, and based on the number information and all validated BET information, the CPU 81 executes winning judgment processing (ST25).

After the bonus game is ended, if the process does not transfer to the progressive bonus (ST13: NO), an award amount is directly calculated with reference to the predetermined payout table (credit amount addition processing: ST14). Calculation of the award amount herein applies to an award acquired according to the gaming result in the gaming section 3 before transferring to the bonus game and an award acquired according to a gaming result of the bonus game in the player gaming section 100, and the calculation result obtained by adding up the awards is stored in a predetermined work area of the RAM 83, and then a winning judgment signal is transmitted to the player terminal 4 (ST09). In the player terminal, the payout result display area 45 and the credit number display area 46 displayed on the BET screen 40 are updated. That is, the player can acquire a normal award in the gaming section 3 and an award of the bonus game in the player gaming section 100 at a time.

In the processing of ST13, when the conditions for the progressive bonus are satisfied, the CPU 81 of the main control unit 80 performs progressive bonus lottery concurrently with the bonus game (ST15). This lottery processing is performed by extracting arbitrary random numbers in the CPU 81, and by extracting the predetermined random numbers, a progressive bonus is won (jack pot).

When the progressive bonus is not won (ST16: NO), according to the processings of ST14 and ST09 described above, calculation of an award amount and transmission of the payout result to the player terminal are executed.

On the other hand, according to the lottery result, when the progressive bonus is won (ST16: YES), credit amount addition processing (ST17) is executed. Calculation of the award amount herein applies to an award acquired according to a gaming result in the gaming section 3 before transferring to the bonus game and an award of winning of the progressive bonus (in detail, BET amounts saved during dice games performed past: saved amount written on the RAM 83 at ST02), and the result of calculation of the added award amounts is stored in a predetermined work area of the RAM 83 and then transmitted to the player terminal 4 (ST09).

At this time, in the player terminal, result display processing for displaying the BET amount and an acquired game medium amount in the payout result display area 45 of the BET screen 40 is performed. That is, the player can acquire a normal award in the gaming section 3, an award of the bonus in the player gaming section 100, and an award of winning of the progressive bonus at a time. Of course, at this time, a special effect may be separately performed on the image display device 7, etc.

Along with this, to move to the next game, the CPU 81 of the main control unit 80 drives the collect/release mechanism 10, 110 to collect the dice on the stop plate 3*c*, 103*c* (ST18), and one game is ended.

In the dice game machine 1 constructed as described above and a dice game of the dice game machine, a player can perform a BET operation via the BET area 41 of the BET screen 40 from the player terminal 4 by predicting the results of rolled numbers on one or more dice (three dice) rolled in the gaming section 3, and furthermore, can perform a BET operation via the BET area 61 of the BET screen 40 from the player terminal 4 by predicting the results of rolled numbers on one or more dice (one dice) rolled in the player gaming section 100 installed in the player terminal.

Thus, in comparison with conventional Sic Bo in which rolled numbers on three dice are predicted, BET operations predicting rolled numbers on more dice can be performed, so that the objects to be bet on can be increased, and accordingly, a high award ratio can be set, so that amusement can be improved. Particularly, in this embodiment, rolled numbers on the dice in the player gaming section 100 exclusive to each player are predicted separately from the gaming section 3, so that a player starts paying attention to the gaming results of the player gaming section 100 as well, and amusement can be improved.

Further, in the above-described embodiment, by performing the above-described bonus game and progressive bonus, a large amount of game media can be acquired, so that amusement can be further improved, and a larger number of players can be made to participate in the game.

The embodiment of the dice game machine and the dice game method of the present invention is described above, however, the present invention is not limited thereto, and can be variously modified.

For example, in the gaming section 3 and the player gaming section 100, the detailed method for rolling and stopping the dice, the unit for judging the rolled numbers on the respective dice, and the method for collecting the dice, etc., are arbitrarily modified. For example, the dice may roll on a diaphragm, and may always be exposed in the gaming section without being collected. In the gaming section 3 and the player gaming section 100, instead of actually rolling the dice, images of dice being rolled and stopped may be displayed by using the image display device.

The numbers of dice to be used in the gaming section 3 and the player gaming section 100 are not limited to the numbers described in the embodiment above but can be variously modified, and accordingly, the BET method and patterns can also be appropriately varied. The dice to be used is not limited to be hexahedral but can be in a polyhedral shape having more exposed surfaces. In this case, on one face of the polyhedral shape, a surface that triggers moving to the bonus game may be formed. The above-described award ratios in the BET portions are only examples, and can be appropriately modified for each region and regulation.

The conditions for enabling the bonus game (conditions for enabling the progressive bonus) and the bonus game contents can be carried out in various ways. For example, instead of using the player gaming section 100, the bonus game may be performed on the image display unit 7. The contents of the bonus game in this case can be carried out in various ways such as a card game, a roulette game, a game like a slot machine, and a dice game, etc.

Further, the present invention is also applicable to a table game in which a dealer handles the dice simply.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A method of conducting a dice game, comprising:

providing a dice gaming machine including a gaming section in which one or more dice roll during a game mode, and a plurality of player terminals, the gaming section being common to each of the player terminals, each player terminal including, installed therein, a player gaming section in which one or more dice roll during the game mode, the player gaming section being exclusive to the respective player terminal in which the player gaming section is installed;

accepting predictions and bets on a respective one of the player terminals during the gaming mode, the predictions and the bets relating to rolled numbers on the one or more dice to be determined in the gaming section and rolled numbers on the one or more dice to be determined in the player gaming section installed in the respective one of the player terminals; and providing an award according to the bet.

2. The dice game method according to claim 1, wherein a special award can be provided under conditions that rolled numbers on the one or more dice rolled in the gaming section and rolled numbers on the one or more dice rolled in the player gaming section are in a predetermined combination and a player who is playing at the player gaming section made a bet predicting the predetermined combination.

3. The dice game method according to claim 1, wherein when rolled numbers on the one or more dice rolled in the gaming section and rolled numbers on the one or more dice rolled in the player gaming section are in a predetermined combination, the player is allowed to play a special game.

4. A dice game machine comprising:

a gaming section to cause one or more dice to roll therein during a game mode;

a plurality of player terminals installed around the gaming section, the gaming section being common to each of the player terminals such that each player terminal accepts predictions and bets related to rolled numbers on the one or more dice rolled in the gaming section during the game mode, each player terminal including a bet display unit to enable bet operations, a player gaming section to cause one or more dice to roll therein during the game mode, the player gaming section being exclusive to the respective player terminal in which the player gaming section is installed such that the respective player terminal accepts predictions and bets related to the rolled numbers on the one or more dice rolled in the player gaming section during the game mode, and a player terminal control unit to control rolling operations of the one or more dice in the player gaming section and each respective; and a control unit to control rolling operations of one or more dice in the gaming section and to control awarding based on a bet operation from the player terminal, the control unit accepts: a bet operation predicting rolled numbers on the one or more dice in the gaming section and a bet operation predicting rolled numbers on the one or more dice in the player gaming section from a player terminal.

5. The dice game machine according to claim 4, wherein the control unit executes special awarding processing for a player terminal under conditions that rolled numbers on one or more dice rolled in the gaming section and rolled numbers on one or more dice rolled in the player gaming section are in a predetermined combination and a player playing with the player terminal performed a bet operation predicting the predetermined combination.

6. The dice game machine according to claim 4, wherein when rolled numbers on one or more dice rolled in the gaming section and rolled numbers on one or more dice rolled in the player gaming section are in a predetermined combination, the corresponding player terminal is allowed to perform a special game.

7. The dice game machine according to any one of claims 4 through 6, wherein the control unit accumulates a predetermined percentage of bet amounts of bet operations accepted from the plurality of player terminals until a predetermined win occurs in any of the plurality of player terminals, at which point the accumulated amount is paid out.

* * * * *